US006742548B2

(12) United States Patent
Enqvist

(10) Patent No.: US 6,742,548 B2
(45) Date of Patent: Jun. 1, 2004

(54) DRYER SCREEN

(75) Inventor: Rauno Enqvist, Nokia (FI)

(73) Assignee: Tamfelt OYJ ABP, Tampere (FI)

( * ) Notice: Subject to any disclaimer, the term of this patent is extended or adjusted under 35 U.S.C. 154(b) by 0 days.

(21) Appl. No.: 10/280,023

(22) Filed: Oct. 25, 2002

(65) Prior Publication Data

US 2003/0066935 A1 Apr. 10, 2003

Related U.S. Application Data

(63) Continuation of application No. PCT/FI01/00483, filed on May 17, 2001.

(30) Foreign Application Priority Data

May 18, 2000 (FI) ..... 20001196

(51) Int. Cl.[7] ..... D03D 15/02

(52) U.S. Cl. ..... 139/383 A; 139/425 A; 428/225

(58) Field of Search ..... 139/383 A, 425 A; 428/225

(56) References Cited

U.S. PATENT DOCUMENTS

| | | | | | |
|---|---|---|---|---|---|
| 3,974,025 | A | | 8/1976 | Ayers | |
| 4,654,052 | A | * | 3/1987 | Sharp | 95/82 |
| 4,789,009 | A | * | 12/1988 | Troughton | 139/383 A |
| 4,815,499 | A | * | 3/1989 | Johnson | 139/383 A |
| 4,934,414 | A | * | 6/1990 | Borel | 139/383 A |
| 5,025,839 | A | * | 6/1991 | Wright | 139/383 A |
| 5,092,373 | A | * | 3/1992 | Lee | 139/383 AA |
| 5,116,478 | A | * | 5/1992 | Tate et al. | 162/358.2 |
| 5,117,865 | A | * | 6/1992 | Lee | 139/383 A |
| 5,465,764 | A | | 11/1995 | Eschmann et al. | |
| 5,840,637 | A | | 11/1998 | Denton et al. | |

FOREIGN PATENT DOCUMENTS

| | | |
|---|---|---|
| GB | 1224048 | 3/1971 |

OTHER PUBLICATIONS

Paper and Timber, vol. 8, No. 2, 2000. (w/abstract).

* cited by examiner

*Primary Examiner*—John J. Calvert
*Assistant Examiner*—Robert H. Muromoto, Jr.
(74) *Attorney, Agent, or Firm*—Oliff & Berridge, PLC

(57) ABSTRACT

A dryer screen, which is woven of flat machine direction threads and round cross-machine direction threads. After weaving the fabric is subjected to heat treatment, and as a result of the strong shrinkage of the weft threads the adjacent warp threads are overlapping in relation to one another on the paper side.

9 Claims, 5 Drawing Sheets

FIG. 1a
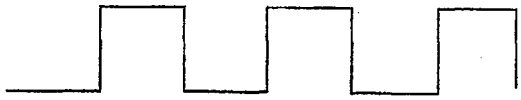
FIG. 1b
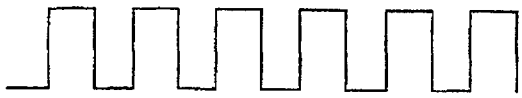
FIG. 1c
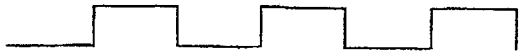
FIG. 1d
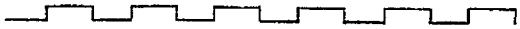
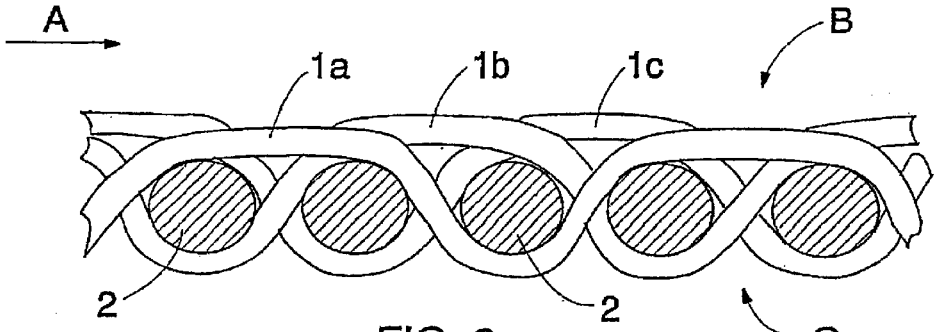
FIG. 2
FIG. 3a
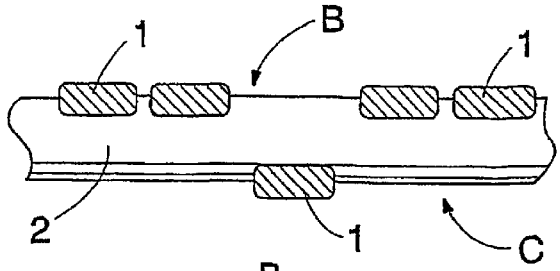
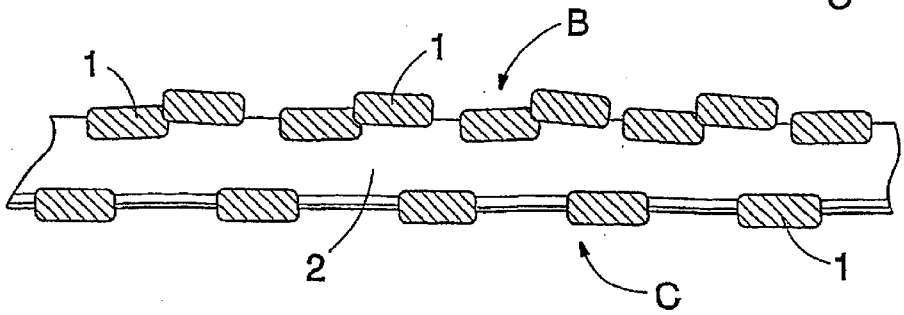
FIG. 3b

DRYER SCREEN

This is a Continuation of Application No. PCT/FI01/00483 filed May 17, 2001. The entire disclosure of the prior application(s) is hereby incorporated by reference herein in its entirety.

FIELD OF THE INVENTION

The invention relates to a dryer screen comprising in cross section flat machine direction threads i.e. warp threads, and in cross section substantially round strongly shrinking cross direction threads i.e. weft threads, said threads forming a single-layer wire cloth, which is subjected to heat treatment after weaving so that the cross direction shrinkage of the wire during heat treatment has shifted the warp threads closer to one another.

BACKGROUND OF THE INVENTION

Dryer screens are used on a dryer section of a paper machine. The dryer screens allow the paper web to be dried to be guided through the dryer section. The fabric of the dryer screen is formed of threads enduring high temperatures and humidity using appropriate bindings. The dryer screen should have a particular permeability in order to make the drying of the web more efficient. Then again a high permeability may cause problems particularly in high-speed (approximately 2000 m/min) machines. Uncontrollable airflows reduce the runability of the wire. As for modern paper machines more and more attention is paid to the aerodynamic properties of the dryer screen. Particularly the air carried by the wire causes runability problems, and therefore wires with a surface that is as smooth as possible have been developed. The idea is to make the wire as thin as possible in order to avoid runability problems caused by speed differences between the wire and the web. Furthermore, the dryer screen should be such that the marking of the web to be dried remains insignificant. This is why attempts are made to provide dryer screens with an even surface structure on the side of the web in order for the web surface to remain as smooth as possible. The web should also be appropriately dried using very little energy and also as rapidly as possible, so that the length of the paper machine remains reasonable. Consequently the contact area of the wire and the number of contact points become important.

It is known in the art that the use of flat threads increases the size of the contact area on the paper side of the dryer screen. Widening the width of flat threads also increases the contact area, but simultaneously reduces the number of contact points per surface area, thus weakening the drying capacity of the dryer screen. This is due to the fact that a reduction of contact points results in a reduction of the number of points pressing the paper web.

FI publication 96885 discloses a dryer screen in which flat machine direction threads pass over at least three, even up to nine, cross threads on the paper side. Furthermore the flat machine direction threads bound together are placed abreast by shrinking the cross threads so that the sides of the machine direction threads are grouped to face one another and thus to form a broader warp thread. A large contact area is provided on the paper side of the wire by passing the flat warp threads set to face one another at the sides for a long distance over the cross threads on the paper side. However, in such a structure the number of contact points on the paper side is small and consequently the drying properties of the wire are inadequate.

SUMMARY OF THE INVENTION

It is an object of the invention to provide an improved dryer screen having a plurality of contact points in addition to a large contact area on the paper side as well as a very smooth paper side surface.

The dryer screen of the invention is characterized in that each warp thread in the wire cloth passes above two weft threads on the paper side of the cloth, below one weft thread on the machine side of the cloth and correspondingly onwards, that the adjacent warp threads show a shift of one weft thread in the machine direction, each warp thread passing one weft thread in relation to the previous warp thread from a different point to the paper side of the cloth and correspondingly to the machine side, that after weaving the paper side surface of the cloth shows empty spaces at the points where the warp threads pass below the weft thread, and that each warp thread is as a result of the strong shrinkage of the weft threads overlapping in relation to the adjacent warp threads at said empty spaces on the paper surface.

The essential idea of the invention is that flat threads are used as machine direction threads, or as warp threads. Threads that are substantially round in cross section and also strongly shrinking are used as cross direction threads, or as weft threads. These threads are used to weave a single-layer fabric, in which the warp thread passes above two weft threads, below a weft thread and continues repeating the same pattern. The other warp threads pass in a corresponding way except that the adjacent warp threads always show a phase shift of one weft thread in relation to the previous warp thread depending on whether the warp thread passes on the paper side or correspondingly on the machine side. In accordance with said phase shift empty spaces are formed on the paper side surface at the points where the warp thread passes below the weft thread. After weaving the basic fabric is subjected to heat treatment, whereby the weft threads shrink powerfully, and as a result they shift the warp threads in the cross direction towards one another, thus narrowing the entire wire. The shrinkage is dimensioned to be so strong that the warp threads overlap with the adjacent warp threads at said empty space on the paper side. Consequently the empty spaces on the paper side are partly filled in the cross direction of the wire on account of the warp threads pushed to said space from both sides.

An essential idea of a preferred embodiment of the invention is that the contact area of the paper side of the wire is 40% or more and that the number of contact points is at the same time 65/cm$^2$ or more.

The invention provides such an advantage that the paper side of the dryer screen is very smooth and the contact area thereof is large. On account of the overlapping warp threads the cover factor of the warp threads is high and the number of contact points is significantly larger than in previous solutions. The smooth surface prevents the marking to the product. In addition the affinity, or the force keeping the web in position, is good on a smooth wire, and thereby the wire controls the course of the web also at high speeds. Another advantage of a smooth-surfaced wire is that the wire is kept clean, and can easily be cleaned in case it is dirtied. The extensive contact area and the large number of contact points simultaneously allow an appropriate heat transmission between the web and the wire.

The wire of the invention provides good running properties. This is due to the fact that the amount of air conducted by a smooth-surface single layer wire is small. Furthermore the wire is very thin, preferably 1.3 mm or less, and the wire has an asymmetric structure, which in turn reduces the difference in running speed of the wire and the web. The extensive contact area and the large number of contact points also provide a higher drying power for the wire. Preferably the level difference of the warp threads on the paper side surface of the wire is then below 0.1 mm.

Still another advantage of the invention is that the wire does not necessarily need to be further processed after weaving and heat treatment, instead it immediately provides the designed properties and it can be directly introduced. Thus, the time consuming mechanical finishing causing additional costs, such as grinding and calendaring, can be left out.

According to previous conceptions (for example U.S. Pat. No. 5,840,637) a single-layer wire is not firm enough to be used as such on a drying section of a paper machine. However, the single-layer wire of the invention is provided with the required stability as the overlapping warp threads are obtained by strongly shrinking the weft threads. In the running tests performed no problems were noted in the running ability of the dryer screen regarding stability.

The dryer screen of the invention is applicable to be used in particular in what are known as single fabric applications, which are common at least in the front end of the drying section of the new high-speed paper machines. In single fabric application the web is conducted merely under the control of a single wire, and not in the conventional way under the control of two wires. Since the single fabric application is generally at the front end of the drying section, the web arriving thereto is still very wet. The wire of the invention is therefore preferable, since a smooth and even the wire as well as an adequate web support owing to the extensive contact area and the large number of contact points intensify the drying of the wet web. The wire also efficiently prevents the marking in the single fabric application. It is commonly known in the art that a difference in running speed exists between the web and the wire in single fabric application. The thin wire of the invention having an asymmetrical structure can be used to successfully reduce said speed difference.

BRIEF DESCRIPTION OF THE FIGURES

The invention will be described in greater detail in the attached drawings, in which FIGS. 1*a* to 1*d* illustrate different topographies of dryer screen surfaces, FIG. 2 schematically shows the cross section of a wire structure of the invention from the cross direction of the machine, FIG. 3*a* schematically shows the cross section of the wire structure shown in FIG. 2 from the machine direction before heat treatment and FIG. 3*b* correspondingly shows the same structure after heat treatment, FIG. 4*a* schematically shows the paper side of the wire shown in FIG. 3*a* before heat treatment and FIG. 4*b* correspondingly shows the paper side of the wire after heat treatment, FIG. 5*a* schematically shows the machine side of the wire shown in FIG. 3*a* before heat treatment and FIG. 5*b* after heat treatment.

DETAILED DESCRIPTION OF THE INVENTION

Figure 4A:
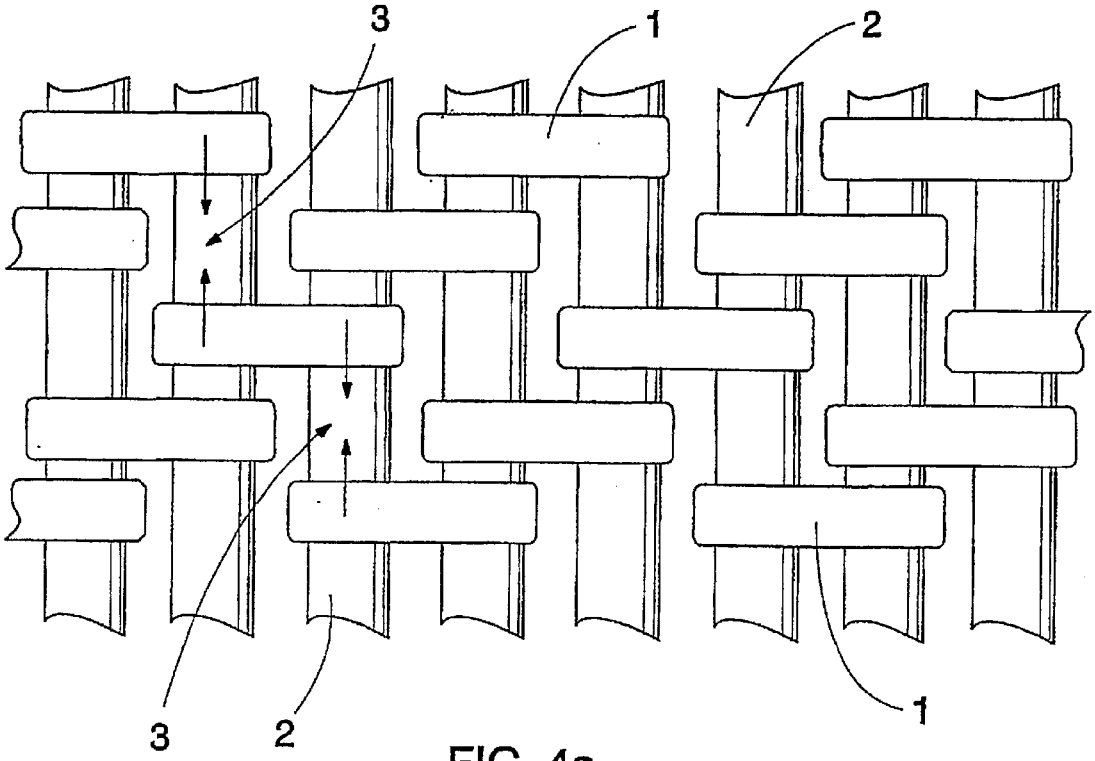

FIGS. 1*a* to 1*d* show different topographies of dryer screens, in which FIGS. 1*a* to 1*c* represent known wires and FIG. 1*d* the wire of the invention. All surfaces include an equal amount of contact area (in this case 50%), but in spite thereof the surface properties of the wires are different. The wire shown in FIG. 1*a* has a rough surface and a few contact points. The wire shown in FIG. 1*b* also has a rough surface but a lot of contact points. Furthermore the wire shown in FIG. 1*c* has, in turn, a fairly smooth surface but a few contact points. FIG. 1*d* illustrates the dryer screen of the invention, whose surface structure of the paper side is very smooth and comprises a plurality of contact points. In comparison with known dryer screens on the market the number of contact points on the paper side of the wire according to the invention is almost doubled. The larger number of contact points can clearly be noted for example by comparing FIGS. 6*a* and 6*b* described below.

FIG. 2 shows the cross section of a wire structure of the invention seen from the cross direction. The wire cloth includes a single layer and it is composed of machine direction warp threads 1*a* to 1*c* and cross direction weft threads 2. The fabric type is a three-shed fabric, meaning that the warp thread always passes above two weft threads on paper side B of the wire, then below one weft thread on machine side C of the paper machine and continues using a corresponding pattern over the next two weft threads etc. As shown in FIG. 2 and below in FIGS. 4*a* and 4*b*, all warp threads in the fabric employ the same binding structure, however, so that adjacent warp threads always comprise a phase shift of one weft thread, i.e. the bindings of adjacent warp threads are always shifted one warp thread in the same direction in the machine direction of the paper machine.

Both the warp threads and weft threads are monofilaments and are made of plastic material. Flat threads are used as warp threads, the cross section of which preferably resembles a rectangle with rounded corners. Such a thread is provided with a larger contact area compared, for example, with flat oval-shaped threads, which can basically also be applied. Examples of possible warp thread materials are polyethylene terephthalate (PET), polyamide (PA), polyphenylene sulphide (PPS), polyether ether ketone (PEEK), polydimethylene cyclohexylene terephthalate (PCTA), and polyethylene naphthalate (PEN). The cross section of the weft threads is, in turn, substantially round, in which case the warp threads run as smoothly as possible between the weft threads, when passing between paper side B and machine side C of the wire. Extremely strongly shrinking threads are employed as the weft threads, meaning that the longitudinal shrinkage of an individual thread is at least 10%. Furthermore the shrinkage in the width direction of the entire wire is at least 10%. The force achieved by shrinking with the weft thread must therefore be very strong, and therefore a particular material is required for the weft thread as well as a specific dimensioning between the weft threads and weft threads. The warp thread material is preferably polyethylene terephthalate (PET).

The thickness of the rectangular warp threads is preferably 0.3 mm or less and the width is 0.6 mm or less. The ratio between the thickness and the width is approximately 1:2. The diameter of the warp threads ranges preferably between 0.6 and 0.8 mm. An increase in both warp and weft thread thickness weakens the surface properties of the wire. If thicker warp threads are used, the weft threads have to be arranged at a greater distance from one another, in order for the thick warp threads to bend between the wefts. If thicker weft threads are used, they are naturally placed further apart from one another. When the weft threads are placed at a greater distance from one another, the warp thread runs for a longer distance on the paper side surface, and consequently the contact area increases but the number of contact points per area simultaneously decreases.

FIG. 3*a* shows a cross section of the wire previously shown in FIG. 2 from the machine direction after weaving, or as a basic fabric. Then the flat warp threads 1 on paper side B are placed next to one another at the weft thread 2, at a distance from one another.

FIG. 3*b* shows the fabric shown in FIG. 3*a* after heat treatment. Heat treatment allows to shrink the weft threads 2 extremely strongly in the longitudinal direction, and consequently the adjacent warp threads 1 overlap in relation to one another.

Figure 4B:
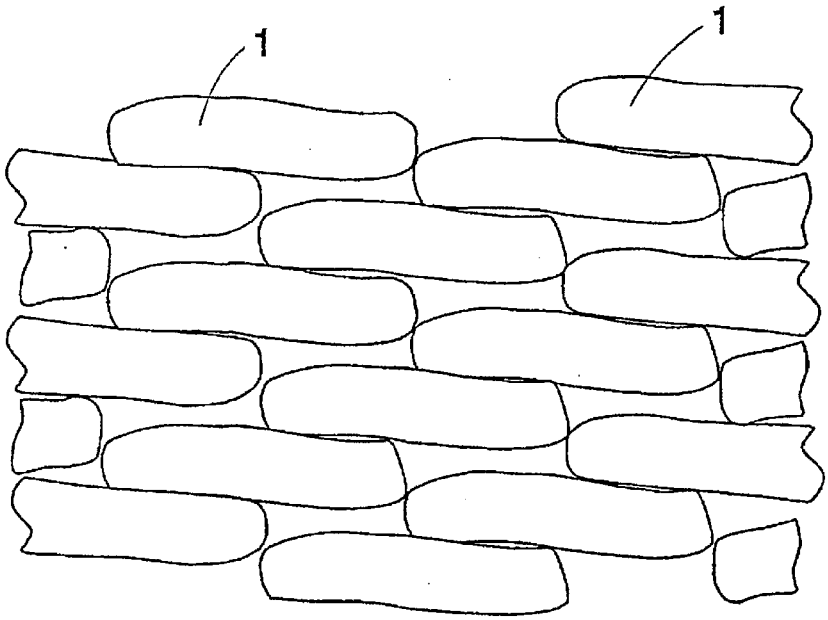

FIG. 4*a* shows the wire according to FIG. 3*a* from the paper side. The warp threads 1 pass above two weft threads 2 on the paper side and thereafter again below one weft thread on the machine side. A corresponding pattern is repeated along the entire warp thread. As the Figure shows the adjacent warp thread pattern comprises a phase shift of one weft thread in the same direction. Then the second warp thread from the top passes in relation to the first warp thread one weft thread behind to the paper side of the wire and correspondingly to the machine side. In the same way the third warp thread from the top passes one weft thread in relation to the second warp thread and also two weft threads in relation to the first warp thread behind to the paper and machine sides. As the Figure shows, certain types of empty spaces 3 are formed on the paper side surface always at that point where the warp thread passes below the weft thread. At an empty space the wire does not have a contact point. As the woven wire is subjected to heat treatment the extremely strongly shrinking weft threads tend to shorten and to simultaneously shift the warp threads closer to one another. In such a case, as the warp thread passes below the fabric at an empty space on the paper side and can therefore not provide cross direction support on the paper side, the adjacent warp threads thereof are able to be pushed to the empty space as indicated by the arrows by means of the shrinking force, and thus overlap with the warp thread passing below the weft thread, as shown in FIG. 4*b*. The warp filling of the fabric is large after heat treatment, since the overlapping warps also fill said empty spaces on the paper side surface.

Figure 5A:
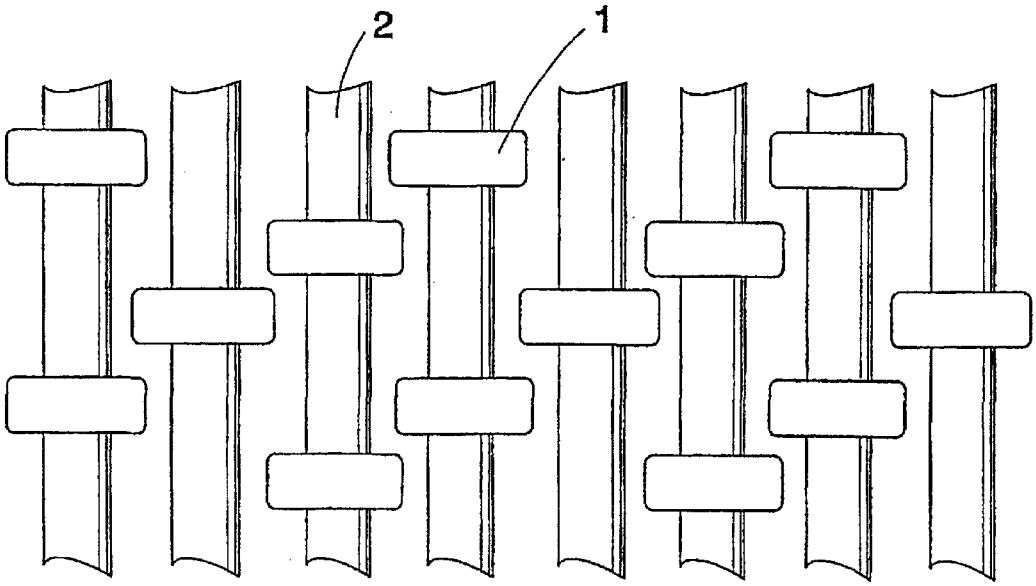
Figure 5B:
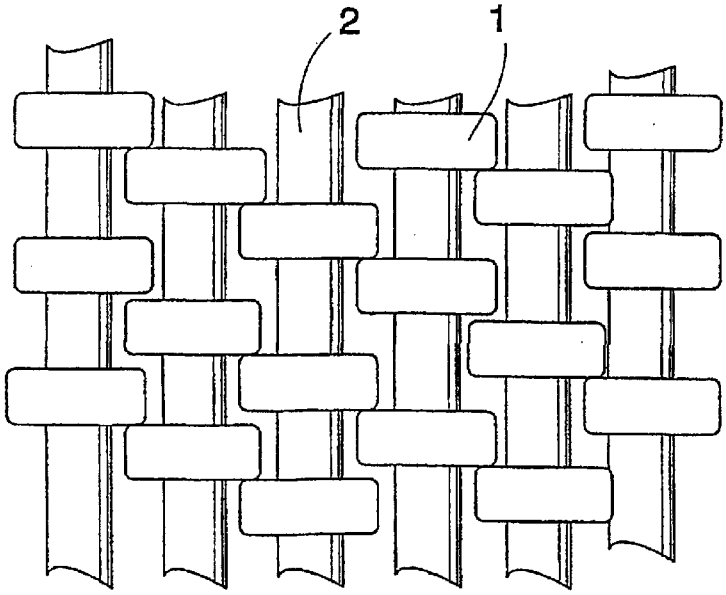

FIG. 5*a* shows the machine side of the wire shown in FIG. 3*a* before heat treatment and correspondingly after heat treatment in FIG. 5*b*. As can be noted when comparing FIGS. 5*a* and 5*b*, the heat treatment substantially makes the fabric dense. After heat treatment the air permeance of the wire is preferably below 2500 $m^3/m^2$ h or less.

Figure 6A:
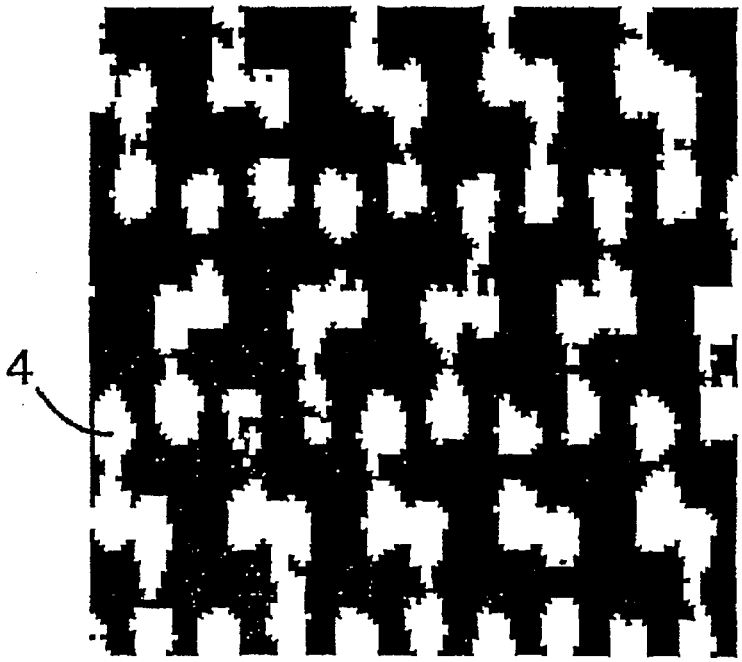
FIG. 6*a* shows images provided by a contact surface analyser of the paper side surface of a known dryer screen and correspondingly
Figure 6B:
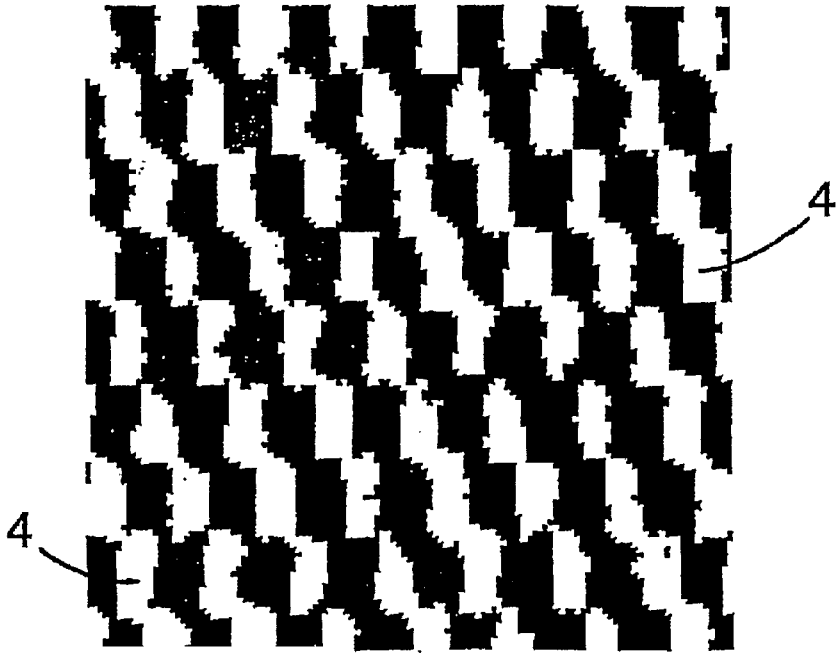
FIG. 6*b* shows an image of the contact surface of the dryer screen of the invention, and FIG. 7 schematically shows another possible paper side of the wire of the invention before heat treatment.

FIG. 6*a* is an image showing the contact surface of the paper side of the wire representing the latest prior art. Such a wire is described, for example, in publication Paperi ja puu (Paper and wood), Vol. 82/No2/2000. Both the machine direction threads and the cross direction threads of said wire are flat, the fabric comprises 1.5 layers and the type thereof is a four-shed fabric. FIG. 6*b* is a corresponding image showing the paper side surface of the wire of the invention. A contact point, or support point, indicate a point in which the warp or weft thread passes on the surface of the fabric. The contact point is considered as a single point irrespective of the number of threads the thread on the surface crosses. The white parts in the Figures illustrate contact surfaces 4. In FIG. 6*a* the number of contact points is in total 63, whereas the number of contact points in the solution of the invention shown in FIG. 6*b* amounts to 72, and is thus significantly larger. In addition the contact area of the wire according to FIG. 6*a* is 30%, whereas the contact area of the wire of the invention is 40% owing to the large number of contact points.

Means for controlling shrinkage are utilized when the dryer screen is subjected to heat treatment, and the shrinkage of the wire in the cross direction is therefore constantly carefully controlled. The basic wire is thus connected from the longitudinal edges thereof to said control means for the duration of the heat treatment, whereby the adjustment of temperature and wire support affects the shrinking process. Heat treatment also improves the dimensional stability of the fabric when used.

EXAMPLE

PET threads, which in cross section are rectangular-shaped with rounded corners having a thickness of 0.29 mm and a width of 0.60 mm, were used as warp threads. The shrinkage of the warp thread was approximately 5%. Round threads with a diameter of 0.70 mm were used as weft threads. The material of the weft threads was also polyethylene terephthalate (PET), and the shrinkage thereof was about 12%. Said threads were used to weave a wire cloth according to FIG. 4*a*. The warp density of the basic fabric was 208/10 cm before heat treatment. The fabric was subjected to heat treatment at a temperature of 180° C. and shrinkage control means were used during heat treatment. After heat treatment the warp density was 240/10 cm. The weft density maintained the value 90/10 cm. The air permeance of the basic fabric was 3000 $m^3/m^2$ h and after heat treatment 2000 $m^3/m^2$ h.

Figure 7:
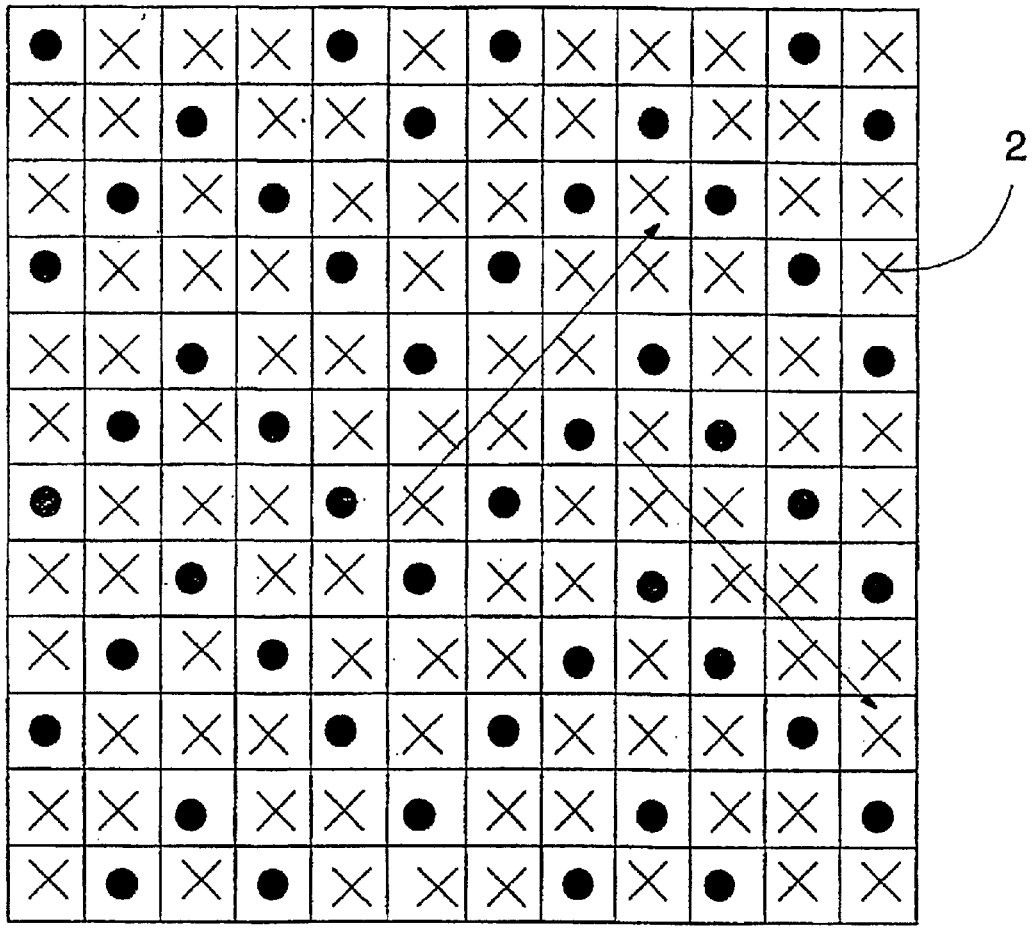

FIG. 7 shows the paper side of another wire before heat treatment. In the Figure (x) indicates that the warp runs on the surface of the fabric and (•) that the warp passes below the weft thread. In other respects the binding structure of said wire corresponds to the one shown in FIG. 4*a* except that now three adjacent warp threads 1 in consecutive order each comprises a shift of one weft thread in relation to the previous warp thread in the same direction, i.e. the diagonal is 1 and in consecutive order the following three adjacent warp threads comprise a shift of one weft thread in relation to the previous warp thread in a different direction than the previous set of three warp threads. The warp threads thus form sets comprising three threads with a diagonal in the same direction. The adjacent three-thread sets have a diagonal in the opposite direction. Also in such a case empty spaces are formed onto the paper side surface to which the adjacent warp threads can be pushed during the heat treatment of the fabric.

The drawings and the specification associated thereto is merely intended to illustrate the idea of the invention. The details of the invention may vary within the scope of the claims.

What is claimed is:

1. A dryer screen comprising:

plurality of machine direction threads, wherein the machine direction threads are warp threads having flat cross section, plurality of cross direction threads, wherein the cross direction threads are weft threads having substantially round cross section, and the weft threads being strongly shrinking threads, and said warp and weft threads forming a single-layer wire cloth wherein each warp thread in the wire cloth passes above two weft threads on the paper side of the cloth, below one weft thread on the machine side of the cloth and correspondingly onwards, and wherein the adjacent warp threads show a shift of one weft thread in the machine direction, each warp thread passing one weft thread in relation to the previous warp thread from a different point to the paper side of the cloth and correspondingly to the machine side, and wherein after weaving the paper side surface of the cloth shows empty spaces at the points where the warp threads pass below the weft thread, and wherein after the wire cloth is subjected to heat treatment each warp thread is, as a result of the strong shrinkage of the weft threads, overlapping in relation to the adjacent warp threads at said empty spaces on the paper surface.

2. A dryer screen as claimed in claim 1, wherein the contact area of the paper side of the dryer screen is 40% or more and the number of contact points on the paper side of the wire is $65/cm^2$ or more.

3. A dryer screen as claimed in claim 1, wherein the air permeance of the dryer screen is 2500 $m^3/m^2h$ or less after the heat treatment.

4. A dryer screen as claimed in claim 1, wherein the shrinkage of the weft thread is over 10% and after weaving the wire has shrunk by means of heat treatment at least 10% in the cross direction.

5. A dryer screen as claimed in claim 1, wherein the thickness of the wire is 1.3 mm or less.

6. A dryer screen as claimed in claim 1, wherein the level difference of the warp threads on the paper side surface of the wire is 0.1 mm or less.

7. A dryer screen as claimed in claim 1, wherein the cross section of the warp thread resembles a rectangle with rounded corners.

8. A dryer screen as claimed in claim 1, wherein the cross section of the warp thread is substantially rectangle and the width of the warp thread is 0.6 mm or less and the height 0.3 mm or less.

9. A dryer screen as claimed in claim 1, wherein the diameter of the weft thread ranges between 0.6 and 0.8 mm.

* * * * *